US010319505B2

(12) United States Patent
Henning, III

(10) Patent No.: US 10,319,505 B2
(45) Date of Patent: Jun. 11, 2019

(54) ELECTRO-MAGNETIC FLUX VALVE

(71) Applicant: OnyxIP, Inc., Huntsville, AL (US)

(72) Inventor: Harvey S. Henning, III, Toney, AL (US)

(73) Assignee: OnyxIP, Inc., Huntsville, AL (US)

( * ) Notice: Subject to any disclaimer, the term of this patent is extended or adjusted under 35 U.S.C. 154(b) by 271 days.

(21) Appl. No.: 15/433,426

(22) Filed: Feb. 15, 2017

(65) Prior Publication Data

US 2017/0236628 A1 Aug. 17, 2017

Related U.S. Application Data

(60) Provisional application No. 62/295,410, filed on Feb. 15, 2016.

(51) Int. Cl.
*H01F 7/06* (2006.01)
*H01F 7/02* (2006.01)

(52) U.S. Cl.
CPC ..... *H01F 7/064* (2013.01); *H01F 7/021* (2013.01)

(58) Field of Classification Search
CPC ..... H01F 7/064; H01F 7/021
See application file for complete search history.

(56) References Cited

U.S. PATENT DOCUMENTS

| | | | | |
|---|---|---|---|---|
| 2,519,425 | A | 8/1950 | Barlow | |
| 3,361,956 | A | 1/1968 | Sola | |
| 3,686,561 | A | 8/1972 | Spreadbury | |
| 3,711,798 | A * | 1/1973 | Richert | H01H 51/284 335/153 |
| 4,467,304 | A * | 8/1984 | Reisem | H01F 7/14 335/227 |
| 8,416,045 | B2 * | 4/2013 | Henning, III | H01F 27/38 336/110 |
| 2008/0303620 | A1 * | 12/2008 | Viitanen | H01F 3/14 336/110 |
| 2018/0366269 | A1 * | 12/2018 | Hori | H01F 38/12 |

* cited by examiner

*Primary Examiner* — Scott Bauer
(74) *Attorney, Agent, or Firm* — Dennen IP Law, LLC

(57) ABSTRACT

The Electro-Magnetic Flux Valve (EMFV) is an electrically actuated permanent magnet field flux shunt comprised of a low reluctance ferromagnetic core, surrounding a permanent magnet, with at least two imbedded control element sections by which the permeance of the core can be reduced. When placed within an external closed magnetic circuit, the EMFV core, at quiescence, acts as a keeper to the magnetic flux of the magnet. When electrically activated, the EMFV core permeance is reduced and the permanent magnet flux is released to energize the external magnetic circuit. When the control signal is removed the EMFV core again becomes highly permeable and constrains the permanent magnet flux thus deenergizing the external magnetic circuit. The EMFV is intended to be an integral part of a Magnetic Power Converter.

10 Claims, 10 Drawing Sheets

ELECTRO-MAGNETIC FLUX VALVE

CROSS-REFERENCE TO RELATED APPLICATION

This application claims priority to U.S. Provisional Patent Application Ser. No. 62/295,410 entitled Electro-Magnetic Flux Valve and filed on Feb. 15, 2016, which is incorporated herein in its entirety.

BACKGROUND

Past concepts involving movable core material and unique coil driven core designs have been employed with limited success to design an economical low power solution for the control of passive Rare Earth Magnet flux in a magnetic power converter. Typically, the goal has been to develop a "solid state" switch with no moving parts that requires a minimal energy input for a wide control of device permeability defined as:

$$\mu = \frac{B}{H} \qquad \text{Equation (1)}$$

Where:

μ=permeability of the core shunt

B=magnetic field flux density in gauss

H=magnetizing force in amperes/meter

Often, an external coil is used to control the flux density B through the core material of the switch device; however, this method has proven to have limited effectiveness due to the inductive reactance limiting the frequency of the input drive signal and the reactive power requirement.

SUMMARY OF THE PRESENT DISCLOSURE

An apparatus of the present disclosure FIG. 1 has a magnet 13 surrounded by a ferromagnetic core 14 acting as a shunt to the magnetic flux field of the magnet 13. The ferromagnetic core may be made of Permalloy steel laminations; however, it may be made of other types of materials in other embodiments. The ferromagnetic core shunt 14 of the present disclosure has two voids 12 and 15 on opposing sides of the magnet 13, which allow a flux control coil 16 to pass through the core shunt 14 and around the magnet 13 thus forming two flux control elements adjacent to the magnet. The voids are configured such that the outer flux path 17 will saturate while the inner flux path 18 will provide a linear flux control proportional to the H field applied by the flux control coil. Note that the outer flux path is the outer portion of the core 14. The flux control coil 16 produces a local magnetic field which circulates around each void 12 and 15 independently and moderates the local flux density around each void thus forming two flux field control elements to moderate the reluctance of the overall core shunt 14.

When the Electro-Magnetic Flux Valve (EMFV) is placed in an external magnetic circuit FIG. 4 the amount of flux control can be quantified from the voltage induced into the output coil 45 as the magnetic flux shifts back and forth. The standard equation for the transformer is based on Faraday's law and produces accurate results for the determination of EMFV flux control.

$$B_m = \frac{E_s \times 10^8}{4.44 f N_s A} \qquad \text{Equation (2)}$$

Where:

$B_m$=magnetic field flux density in gauss $E_S$=voltage induced in the output coil in rms f=the frequency of operation in Hertz $N_S$=the number of turns in the output coil A=the cross sectional area of the output core 44 in square centimeters The total amount of flux controlled by the EMFV is actually twice the value calculated by equation 2 due to the fact that the EMFV controls the flux in one direction. In FIG. 6, when the flux 61 shifts into the external magnetic circuit 62 the voltage in the output coil 66 swings to a positive peak value. In FIG. 5, when the flux 51 shifts out of the external magnetic circuit 52 and the magnetic flux 51 is again constrained by the EMFV, the voltage in the output coil 56 swings to a negative peak value.

The boost circuit FIG. 9 used to drive the EMFV is unique in that the pulse and boost cycles are electrically isolated to support the recovery of a large part of the reactive power required to operate the EMFV. The isolated boost circuit also employs a bootstrap capacitor C1 to establish a boost base threshold voltage level to maximize the energy transfer back into the D C Link (DCL) C2 and the battery B1.

BRIEF DESCRIPTION OF THE DRAWINGS

The present disclosure can be better understood with reference to the following drawings. The elements of the drawings are not necessarily to scale relative to each other, emphasis instead being placed upon clearly illustrating the principles of the disclosure.

DETAILED DESCRIPTION

Figure 4:
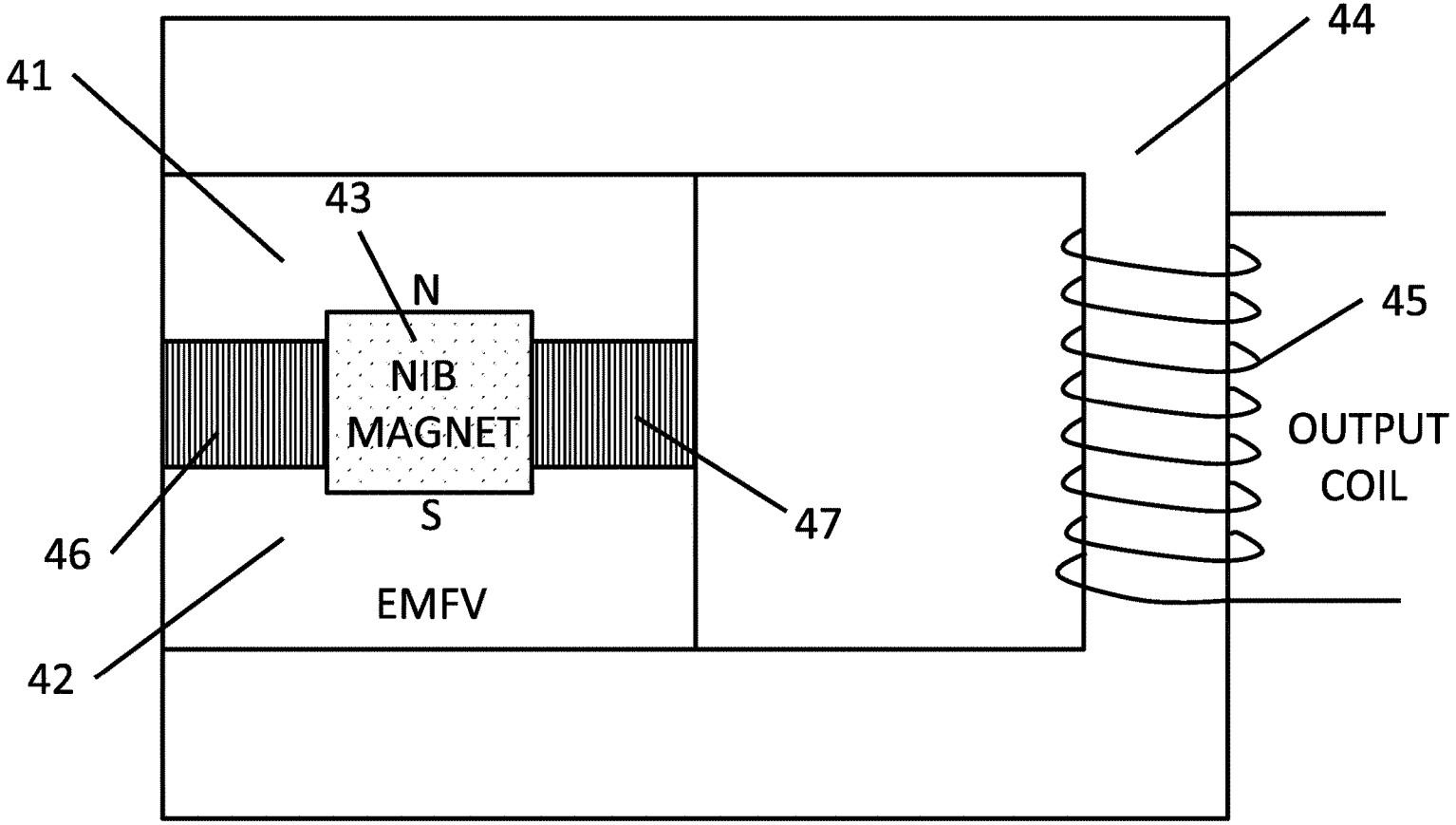
FIG. 4 is a plan view of the EMFV placed within an external magnetic circuit which includes an output coil to measure flux density according to an exemplary embodiment of the present disclosure.

The EMFV of the present disclosure of FIG. 4 consists of a permanent magnet encircled by a low reluctance ferromagnetic shunt core 14 (FIG. 1) composed of segments 41, 42, 46 and 47 that control the flux produced by the magnet 43. Two of the shunt core segments, 46 and 47, are configured to control a flux produced by the magnet 43. When the flux control segments 41, 42, 46, and 47 are electrically energized, their reluctance increases and the permanent magnet flux shifts from the shunt core to the external magnetic circuit core 44. The output coil 45 in the external magnetic circuit 44 is used to quantify the amount of flux that the EMFV is able to control.

Figure 1:
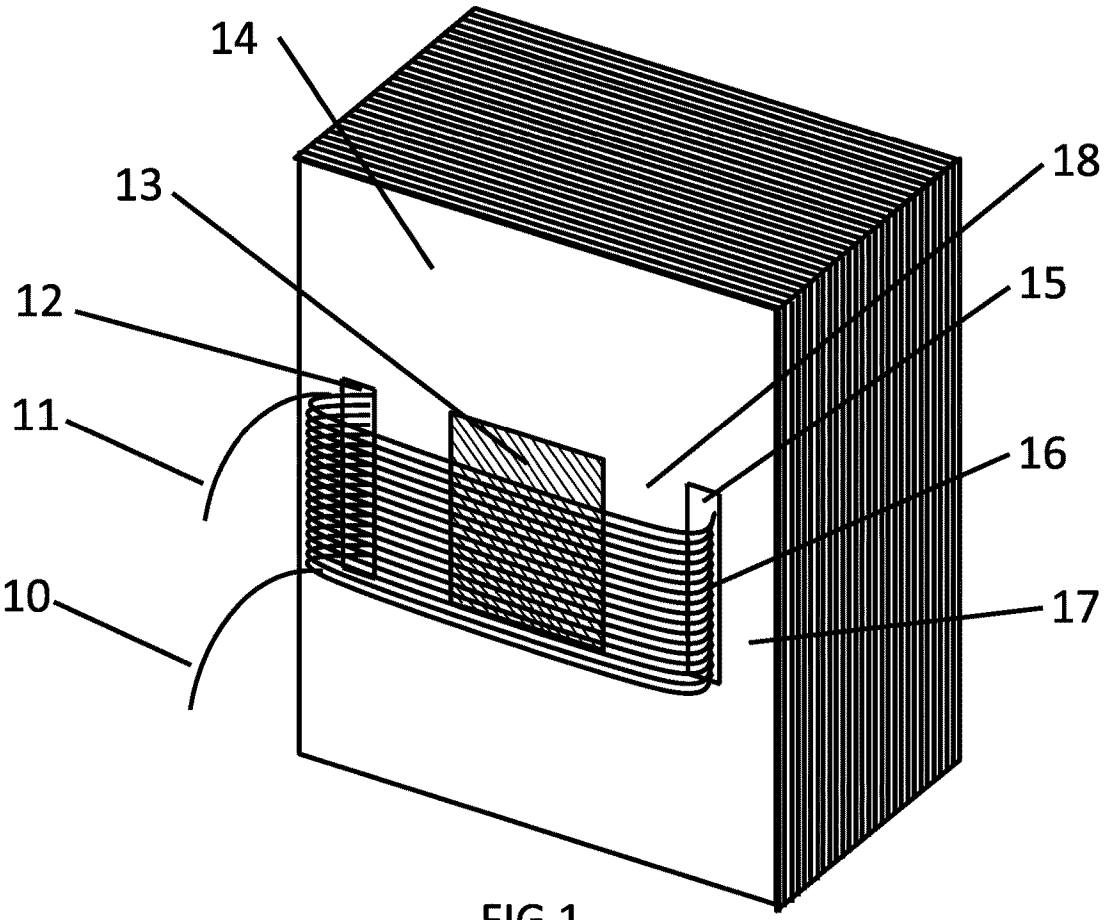
FIG. 1 is an isometric view of the Electro-Magnetic Flux Valve (EMFV) according to an exemplary embodiment of the present disclosure.

The present notional example shown in FIG. 1 employs an embedded coil 16 to form the two flux control segments in the shunt core 14. The coil 16, when energized, produces a localized magnetic field around each void 12 and 15 in the shunt core 14. The magnetic field causes the reluctance in the flux control segments 46 and 47 (FIG. 4) to increase toward saturation.

The present notional example FIG. 1 has the voids in the control segments 12 and 15 placed off center with respect to the shunt core 14 to allow the outer flux path 17 to saturate before the inner flux path 18 thus providing linear control of the permanent magnet 13 flux through the shunt 14.

Figure 2:
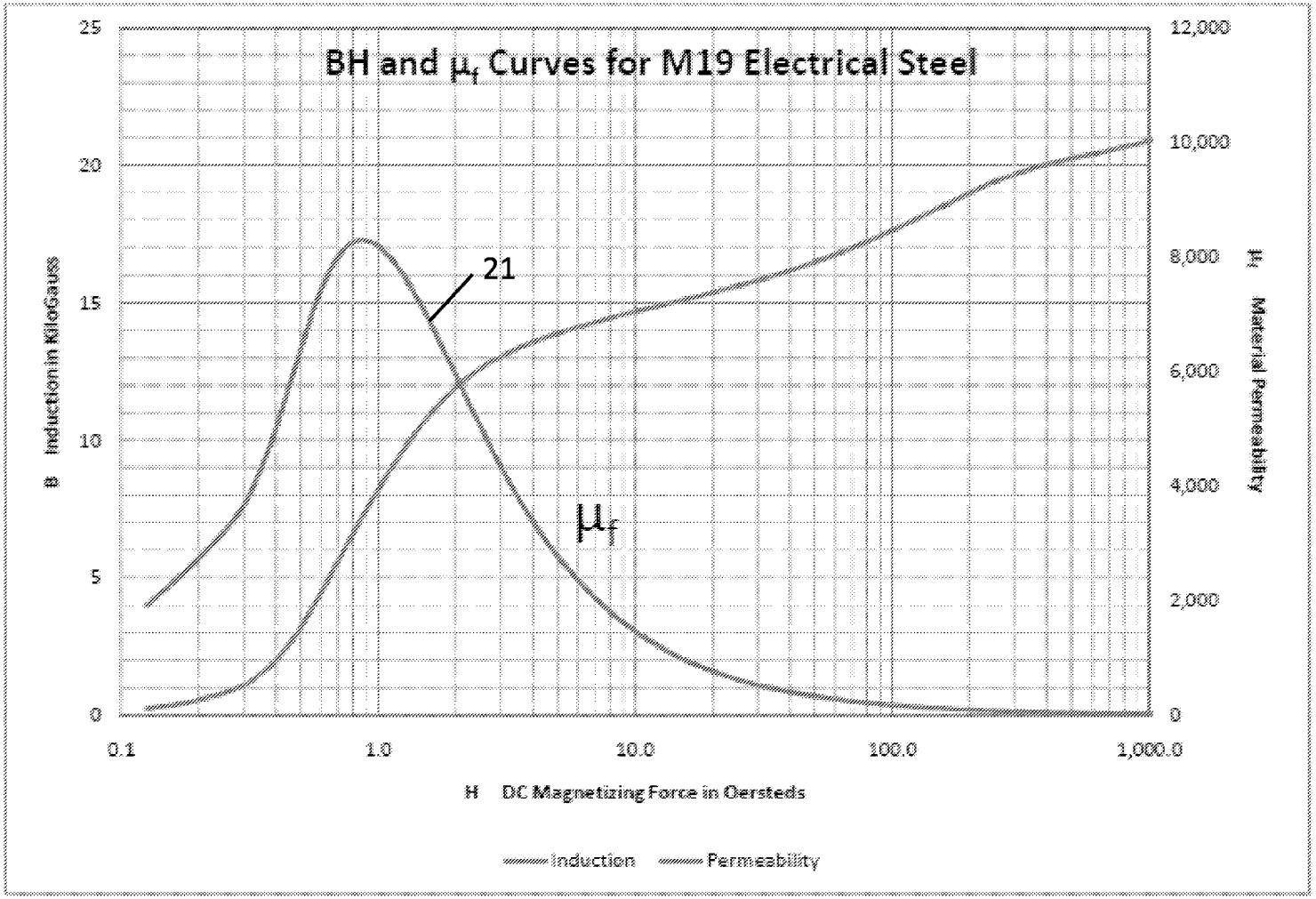
FIG. 2 illustrates an induction curve and the Stoletov curve for M19 electrical steel.

In one embodiment, M19 electrical steel laminations may be used for the shunt 14. Note that FIG. 2 shows the Stoletov curve 21 for the M19, which indicates that even when saturated the material is still quite permeable. Note that other types of material may be used in other embodiments.

Figure 3:
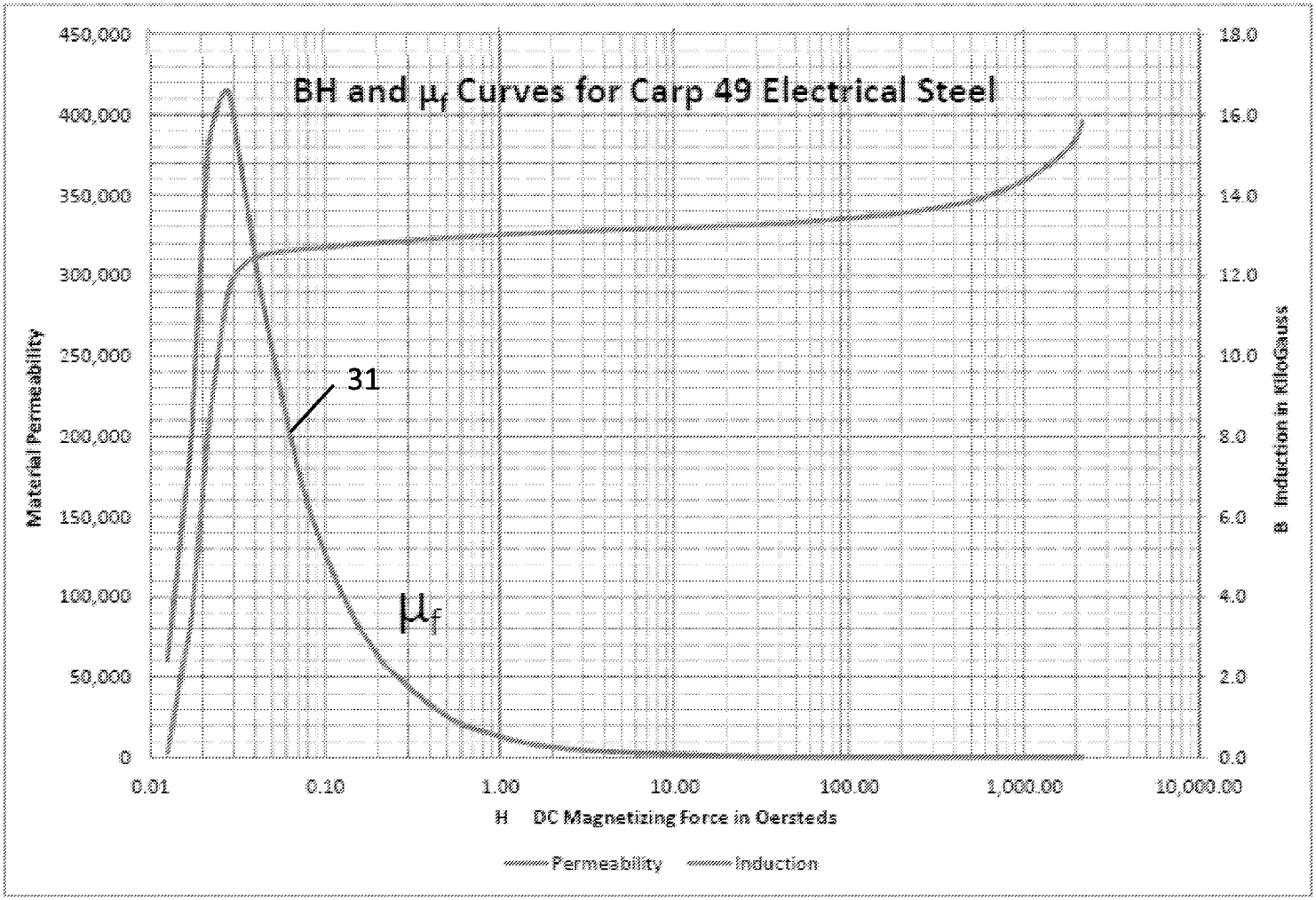
FIG. 3 illustrates the induction curve and the Stoletov curve for Carp 49 electrical steel.

In such an embodiment, the shunt core 14 may be fabricated with Carp 49 Permalloy. In FIG. 3 the Stoletov curve 31 for the Carp 49 Permalloy 31 shows a reduction in coercion force that achieves saturation and also demonstrates the drop in permeability above saturation.

Figure 5:
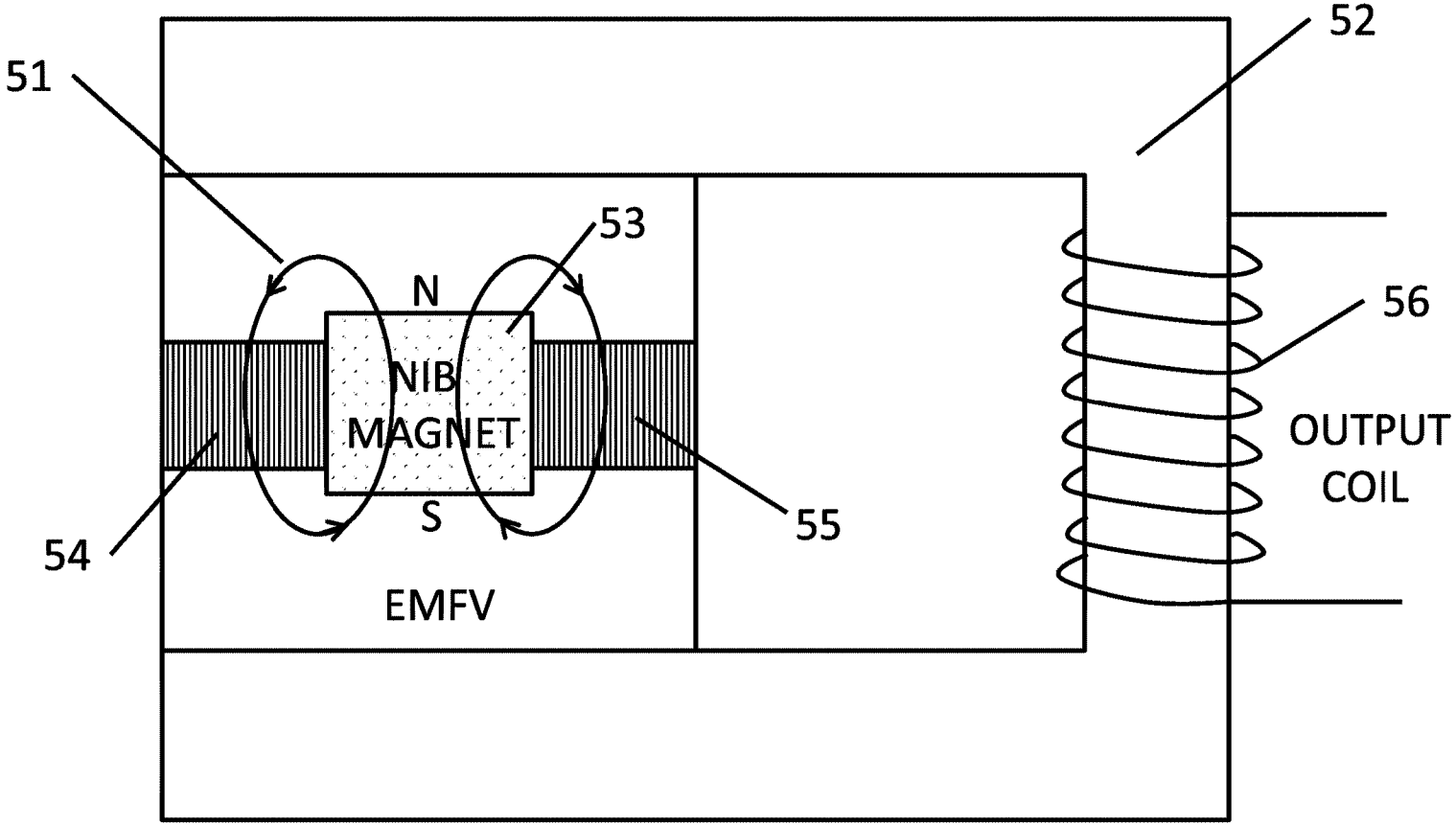
FIG. 5 is a plan view of the EMFV, with the control elements at quiescence, showing the permanent magnet flux constrained within the EMFV shunt circuit.
Figure 6:
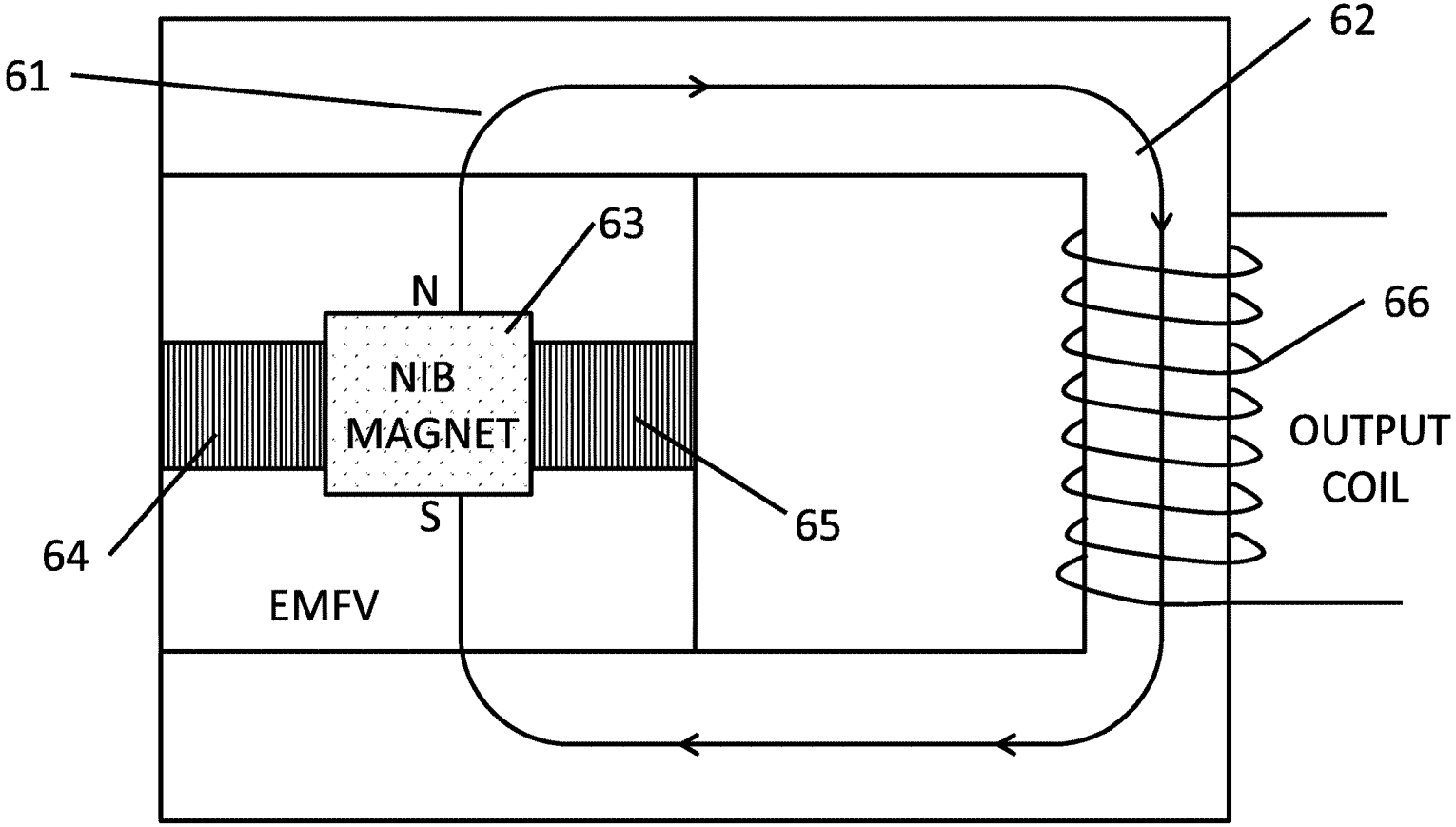
FIG. 6 is a plan view of the EMFV, with the control elements energized, showing the permanent magnet flux shifted out of the EMFV shunt circuit into the external magnetic circuit.

The magnetic flux control afforded by the present notional example FIG. 1 can be quantified when placed in an external magnetic circuit FIG. 4 and turned on and off. When the EMFV is deenergized the permanent magnet flux is constrained by the shunt core 14 as in FIG. 5. When the EMFV is energized the permanent magnet flux is free to energize the external magnetic circuit path as in FIG. 6.

Figure 7:
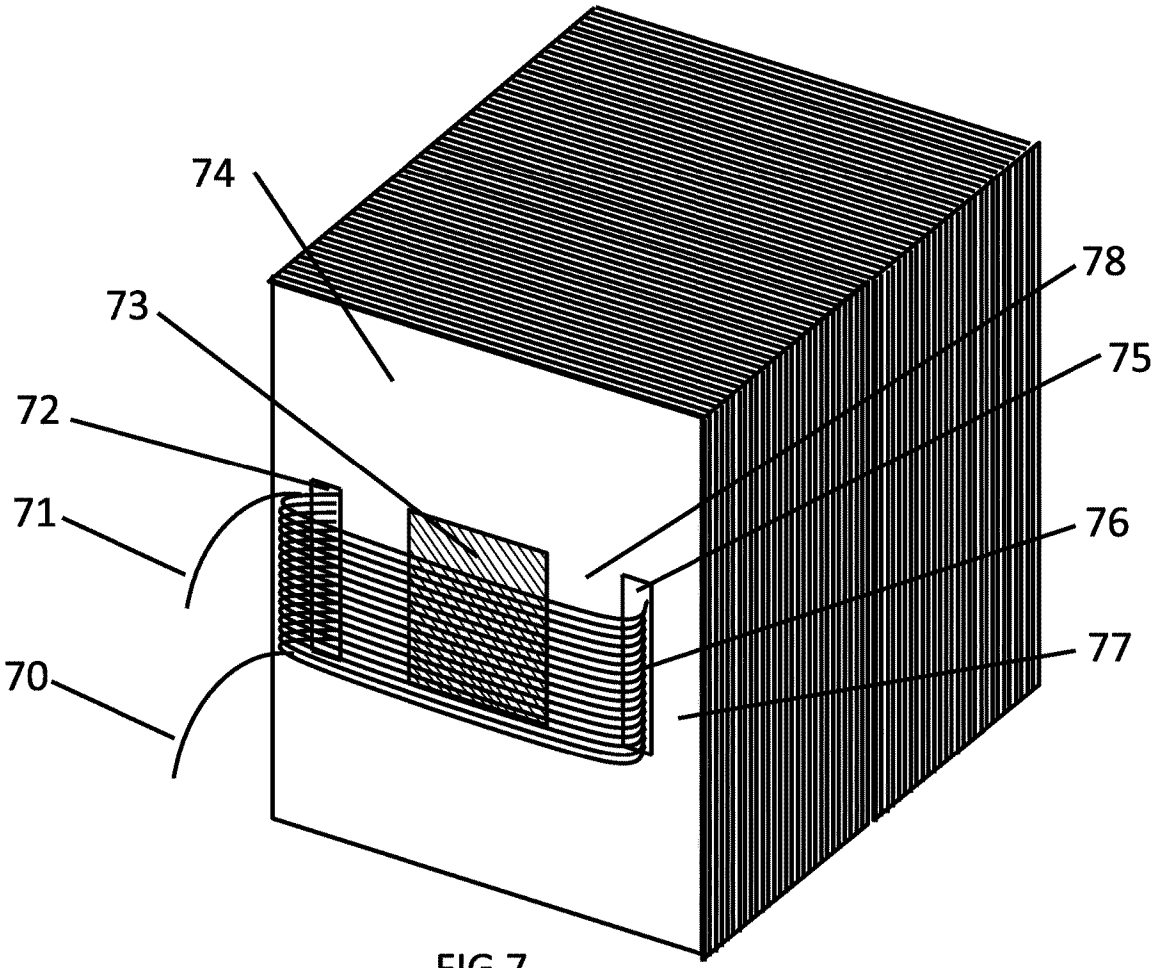
FIG. 7 is an isometric view of the widened core version of the Electro-Magnetic Flux Valve (EMFV) according to an exemplary embodiment of the present disclosure.
Figure 8:
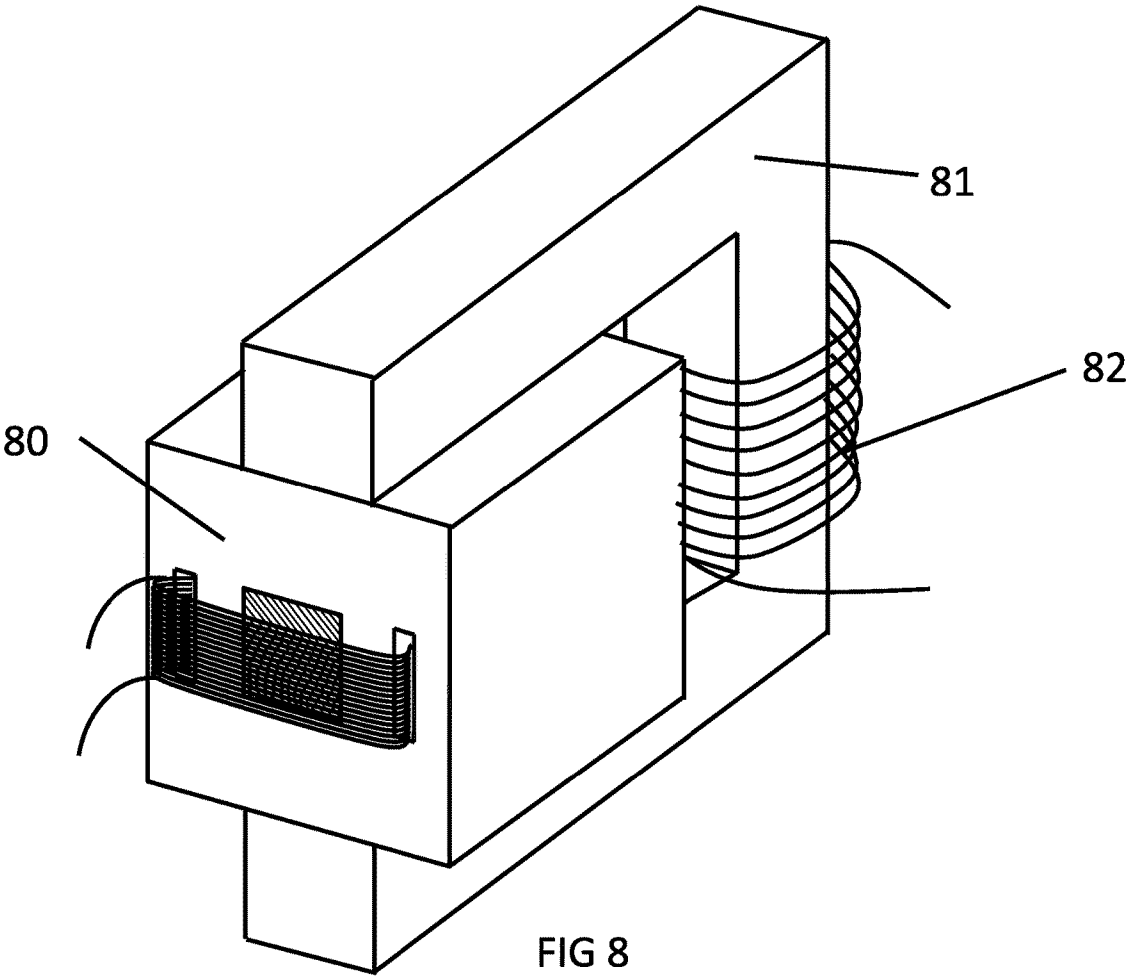
FIG. 8 is an isometric view of the widened core version of the Electro-Magnetic Flux Valve (EMFV) placed in an external frame according to an exemplary embodiment of the present disclosure.

In one embodiment, the amount of flux that the EMFV can control may be determined by the cross section of the permanent magnet and the width of the ferromagnetic shunt core shown in FIG. 7. In this embodiment, the magnet 73 and the shunt core 74 are made wider and then placed in the external magnetic circuit orthogonally as depicted in FIG. 8 where the flux density in the external circuit would increase.

The present notional example FIG. 1 is shown driven with a flux control coil 16. The flux control coil 16 and the ferromagnetic shunt core 14 together form an electromagnet which when energized acts to reinforce a flux field produced by the permanent magnet 13. When the flux control coil 16 is overdriven, beyond what is required to simply shift the permanent magnet flux into the external magnetic circuit as shown in FIG. 8, the extra flux produced by the "electromagnet" is passed into the external circuit to be added to the flux density quantified by the output coil 82.

The EMFV is electrically driven to shift the permanent magnet flux out of the shunt core. The reactive power to overcome the inductance of the drive circuit is normally lost but in this case it may be recovered by the drive circuit to promote performance efficiency.

The conventional boost converter circuit takes power from the source and boosts the voltage to be delivered to the load. The Isolated boost converter in this notional example is different in that the power taken from the input source battery is able to be largely recovered and returned to the same source battery to be reused. This is accomplished, as seen in FIG. 9, by modifying the input of the conventional circuit design with the addition of an isolation power switch Q1 and an integral bootstrap capacitor C1 to establish the boost voltage threshold to force the recovered charge back into the source battery in support of the Recovery Cycle as shown in FIG. 10.

Figure 9:
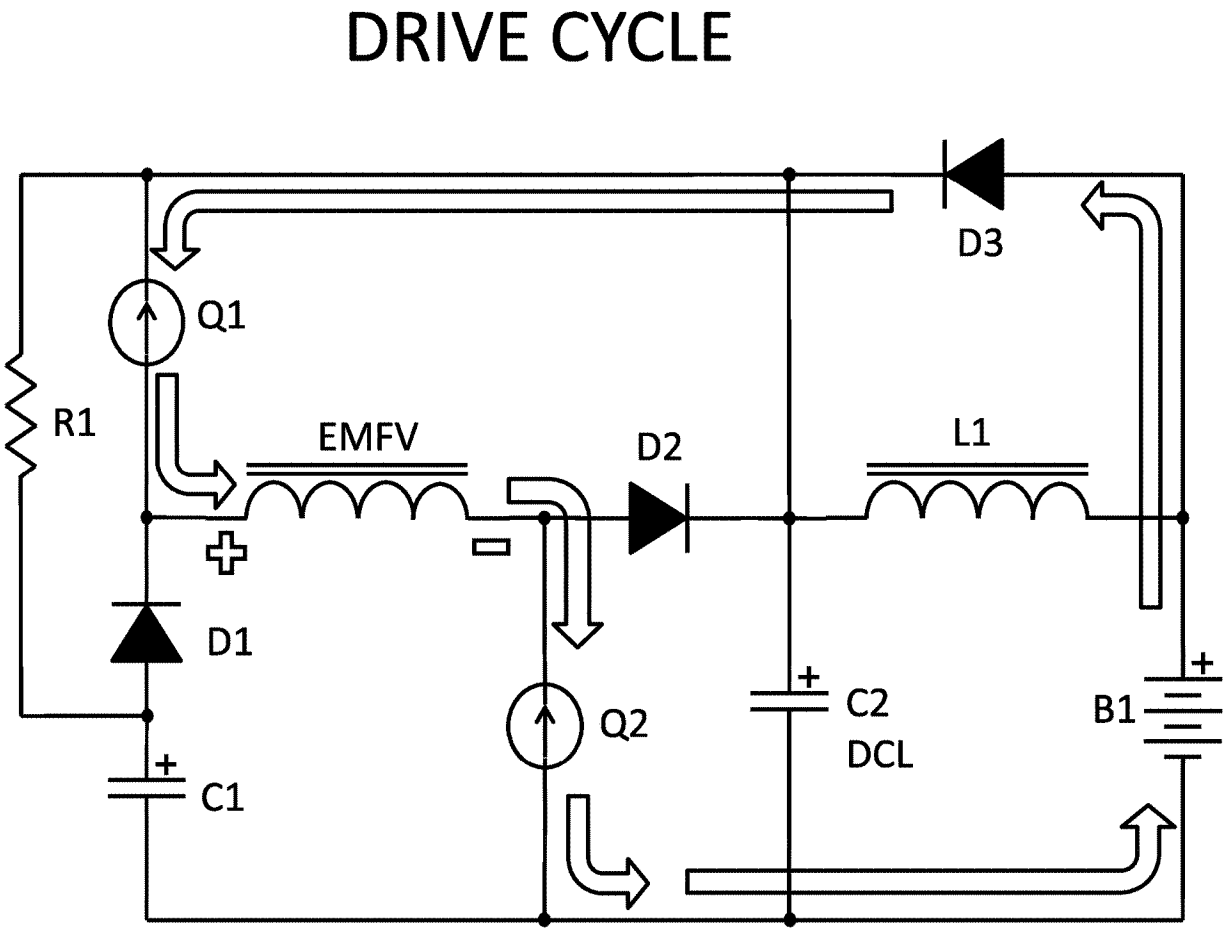
FIG. 9 is a simplified schematic diagram of the isolated boost circuit used to drive the EMFV according to an exemplary embodiment of the present disclosure operating in the Drive Cycle.

In FIG. 9 the Drive Cycle is initiated by switches Q1 and Q2 turning on simultaneously and supplying drive current from the DC Link capacitor C2 and the battery through D3 to the EMFV which begins to shift the permanent magnet flux out of the shunt core. The boost capacitor C1 is charged to the battery B1 potential passively through R1 in preparation for the Recovery Cycle. As the current flows through the EMFV the local flux builds until the control segments saturate at which point switches Q1 and Q2 open up and the magnetic flux which has built up collapses.

Figure 10:
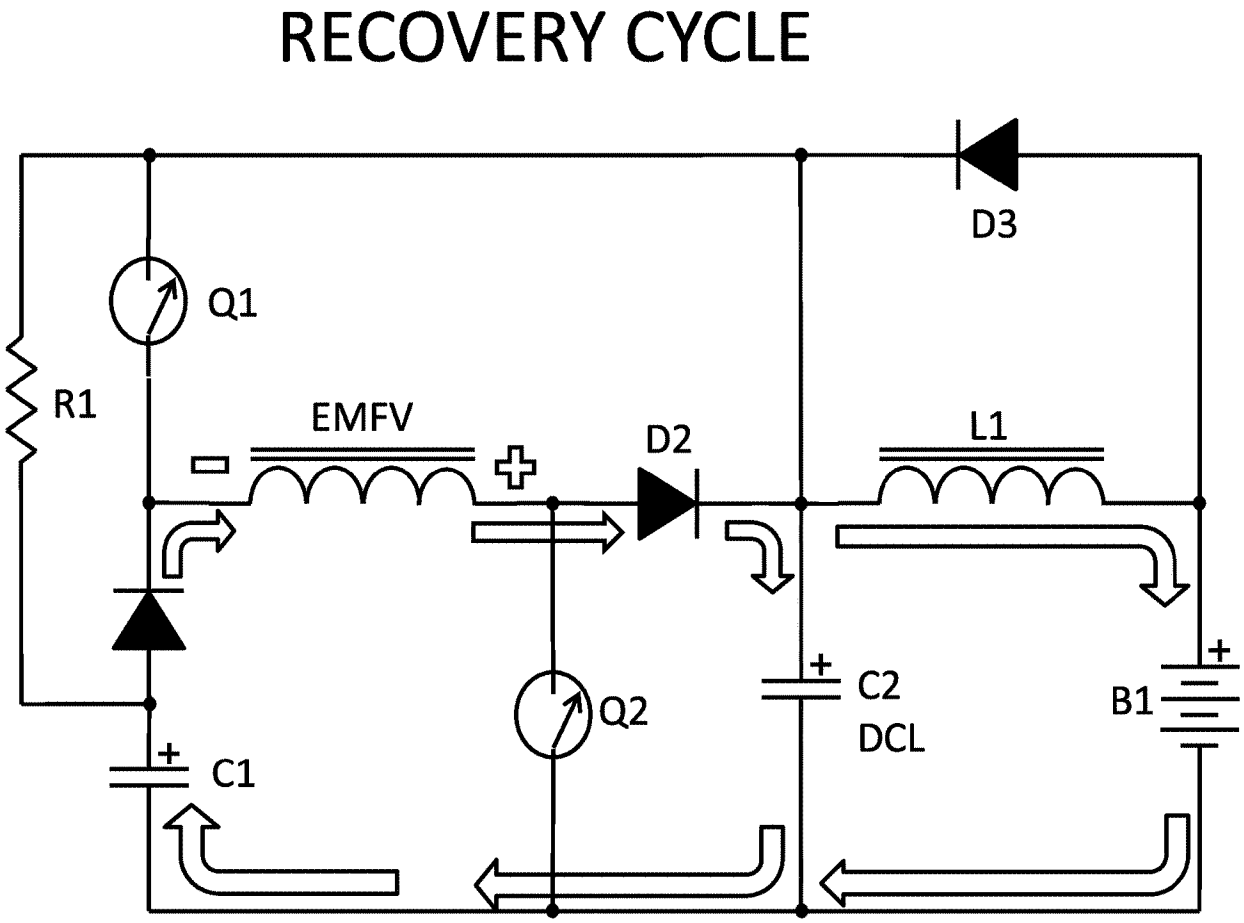
FIG. 10 is a simplified schematic diagram of the isolated boost circuit used to drive the EMFV according to an exemplary embodiment of the present disclosure operating in the Recovery Cycle.

In FIG. 10 the Recovery Cycle commences as the permanent magnet flux rushes back into the shunt core and induces a reverse polarity voltage into the EMFV control winding. The EMFV control winding voltage boosts the charge in the bootstrap capacitor C1 and conducts through D2 to charge the DC Link capacitor C2 which in turn transfers charge back to the battery through the saturable reactor L1. When the Recovery Cycle concludes the Drive Cycle begins again.

The foregoing discussion discloses and describes exemplary methods and embodiments of the present disclosed disclosure. The disclosure is intended to be illustrative, but not limiting, of the scope of the apparatuses and methods, which are set forth in the following claims.

What is claimed is:

1. An apparatus, comprising:

a magnet completely surrounded by a ferromagnetic shunt core on four sides;

at least two embedded flux control element sections within the shunt core such that when electrically energized a reluctance of the shunt core increases to a point of magnetic saturation.

2. The apparatus of claim 1, further comprising an external closed magnetic circuit electrically coupled configured for providing a flux path for the magnet when electrically energized.

3. The apparatus of claim 1, wherein the shunt core is formed in the same plane or orthogonally within a frame of an external magnetic circuit.

4. The apparatus of claim 1, wherein the shunt core is wider than a frame of an external magnetic circuit if it is oriented orthogonally.

5. The apparatus of claim 4, wherein the shunt core controls flux through the external magnetic circuit frame resulting from a wide shunt core cross section.

6. The apparatus of claim 1, wherein the two embedded flux control element sections within the shunt core is driven by a coil.

7. The apparatus of claim 1, wherein the two embedded flux control element sections within the shunt core are configured to actively moderate a total reluctance of the shunt core when energized.

8. The apparatus of claim 1, further comprising a coil traversing a first void and a second void, the first void on a positioned adjacent a first side of the magnet and the second void positioned adjacent a second side of the magnet, the coil, when energized, produces a localized magnetic field around the first void and the second void in the shunt core, wherein when the at least two embedded flux control elements are energized via the magnetic field.

9. An apparatus, comprising:

a magnet surrounded by a ferromagnetic shunt core;

at least two embedded flux control element sections within the shunt core such that when electrically energized a reluctance of the shunt core increases to a point of magnetic saturation; and a boost converter drive circuit configured to use an input power switch which isolates the boost converter circuit from a power source during a boost or a recovery phase of operation.

10. An apparatus, comprising:

a magnet surrounded by a ferromagnetic shunt core;

at least two embedded flux control element sections within the shunt core such that when electrically energized a reluctance of the shunt core increases to a point of magnetic saturation; and a boost converter drive circuit configured to use a passively charged bootstrap capacitor circuit at an input, wherein the passively charged bootstrap capacitor circuit is configured as a clamper to establish a boost voltage threshold during a recovery cycle.

* * * * *